US008182003B2

(12) United States Patent
Dye et al.

(10) Patent No.: US 8,182,003 B2
(45) Date of Patent: May 22, 2012

(54) EXIT DEVICE AND METHOD OF OPERATING THE SAME

(75) Inventors: William P. Dye, Indianapolis, IN (US); Raymond F. Rettig, Fishers, IN (US); William W. Myntti, Indianapolis, IN (US)

(73) Assignee: Von Duprin LLC, Indianapolis, IN (US)

( * ) Notice: Subject to any disclaimer, the term of this patent is extended or adjusted under 35 U.S.C. 154(b) by 946 days.

(21) Appl. No.: 12/193,781

(22) Filed: Aug. 19, 2008

(65) Prior Publication Data

US 2010/0045053 A1 Feb. 25, 2010

(51) Int. Cl.
*E05B 65/10* (2006.01)

(52) U.S. Cl. ..... 292/92; 292/216

(58) Field of Classification Search ..... 292/216, 292/92, 144; 49/13, 38; 340/5.5, 5.55
See application file for complete search history.

(56) References Cited

U.S. PATENT DOCUMENTS

| | | | | |
|---|---|---|---|---|
| 3,722,938 | A | 3/1973 | Bauer et al. | |
| 4,633,688 | A | 1/1987 | Beudat et al. | |
| 4,799,719 | A * | 1/1989 | Wood | 292/144 |
| 4,801,163 | A | 1/1989 | Miller | |
| 4,875,722 | A | 10/1989 | Miller | |
| 5,070,442 | A | 12/1991 | Syron-Townson et al. | |
| 5,410,301 | A * | 4/1995 | Dawson et al. | 340/5.33 |
| 5,429,399 | A | 7/1995 | Geringer et al. | |
| 5,525,963 | A | 6/1996 | Purssey | |
| 5,988,708 | A | 11/1999 | Frolov et al. | |
| 6,116,664 | A | 9/2000 | Wegner | |
| 6,527,310 | B1 | 3/2003 | Bellamy | |
| 6,568,726 | B1 | 5/2003 | Caspi et al. | |
| 6,655,180 | B2 * | 12/2003 | Gokcebay et al. | 70/432 |
| 6,769,723 | B2 | 8/2004 | Cohrs, Jr. et al. | |
| 6,848,729 | B2 * | 2/2005 | Caspi et al. | 292/341.16 |
| 6,879,058 | B2 | 4/2005 | Lorenz et al. | |
| 7,000,954 | B2 | 2/2006 | Cohrs, Jr. et al. | |
| 7,070,213 | B2 | 7/2006 | Willats et al. | |
| 7,484,777 | B2 * | 2/2009 | Condo et al. | 292/92 |
| 2003/0052538 | A1 | 3/2003 | Lorenz et al. | |
| 2003/0178857 | A1 | 9/2003 | Caspi et al. | |
| 2004/0041412 | A1 | 3/2004 | Cohrs, Jr. et al. | |
| 2004/0195845 | A1 | 10/2004 | Chevalier | |
| 2004/0227350 | A1 | 11/2004 | Cohrs, Jr. et al. | |
| 2004/0227353 | A1 | 11/2004 | Cohrs, Jr. et al. | |
| 2005/0012343 | A1 | 1/2005 | Warden et al. | |
| 2005/0184534 | A1 | 8/2005 | Oberheide et al. | |
| 2008/0012350 | A1 * | 1/2008 | Condo et al. | 292/92 |

* cited by examiner

*Primary Examiner* — Gary Estremsky
(74) *Attorney, Agent, or Firm* — Michael Best & Friedrich LLP

(57) ABSTRACT

The invention provides a method of operating an exit device. The exit device includes a locking mechanism for locking and unlocking a door, the locking mechanism having a latch bolt movable between an extended state and a retracted state, and a link connected to the latch bolt and movable between locked and unlocked positions, movement of the link between the locked and unlocked positions causing movement of the latch bolt between the extended state and the retracted state to lock and unlock the door, and a motor operably connected to the link. The method comprises operating the motor to move the link in a first direction toward the unlocked position, the motor being operated until the link reaches a hard stop position; thereafter determining a soft stop position based on the hard stop position; and thereafter selectively using the motor to move the link in the first direction toward the unlocked position, the motor being operated only until the link reaches the soft stop position.

22 Claims, 13 Drawing Sheets

EXIT DEVICE AND METHOD OF OPERATING THE SAME

BACKGROUND

The present invention relates to exit devices generally utilized for locking and unlocking emergency and/or fire exit doors. Operation of exit devices generally includes pushing an exit bar or pushbar that in turn actuates a locking mechanism to unlock the door allowing a user to exit the building. One feature of exit devices includes dogging the exit device, i.e., unlocking the exit device and maintaining the unlocked state to allow free passage through the door the exit device is mounted on. Generally, mechanical dogging systems or devices are utilized to maintain the exit device in the unlocked state. However, to place and maintain the exit device in the unlocked state necessitates a user or maintenance person to actuate the mechanical dogging device.

As a solution, solenoid actuated mechanisms have been used to replace the mechanical dogging devices providing, in some cases, "unmanned" operation of the exit device. Particularly, solenoid actuated locking mechanisms allow unlocking and maintaining the unlocked state of the locking mechanism. However, solenoid actuated mechanisms are also characterized by abruptly changing the state of the locking mechanism from locked to unlocked, and vise versa. This abrupt change in state can cause the locking mechanism to wear more rapidly and can generate an excessive amount of noise.

SUMMARY

In one embodiment, the invention provides a method of operating an exit device, the exit device including a locking mechanism for locking and unlocking a door, the locking mechanism having a latch bolt movable between an extended state and a retracted state, and a link connected to the latch bolt and movable between locked and unlocked positions, movement of the link between the locked and unlocked positions causing movement of the latch bolt between the extended state and the retracted state to lock and unlock the door, and a motor operably connected to the link, the method comprising: operating the motor to move the link in a first direction toward the unlocked position, the motor being operated until the link reaches a hard stop position; thereafter determining a soft stop position based on the hard stop position; and thereafter selectively using the motor to move the link in the first direction toward the unlocked position, the motor being operated only until the link reaches the soft stop position.

In another embodiment, the invention provides a method of operating an exit device, the exit device including a locking mechanism including a latch bolt operable between an extended state and a retracted state, a motor having a motor shaft, a control module operable to control the motor, the control module having a sensing system and a microcontroller, and a link coupling the motor shaft to the locking mechanism, the method comprising: generating a signal indicative of the position of the link; operating the motor for moving the link in a first direction; thereafter recording a hard stop value of the signal indicative of a hard stop position of the link; thereafter determining a soft stop value, the soft stop value being indicative of a soft stop position of the link.

In another embodiment, the invention provides an exit device for locking and unlocking a door, the exit device comprising: a housing adapted to be fixedly coupled to the door, a locking mechanism at least partially enclosed by the housing for locking and unlocking the door, the locking mechanism including a link movable between locked and unlocked positions and a latch bolt connected to the link and operable between an extended state and a retracted state; a stepper motor for moving a motor shaft connected to the link; and a microcontroller for operating the motor, wherein the microcontroller includes instructions for operating the motor to move the link in a first direction toward the unlocked position, the motor being operated until the link reaches a hard stop position; thereafter determining a soft stop position based on the hard stop position; and thereafter selectively using the motor to move the link in the first direction toward the unlocked position, the motor being operated only until the link reaches the soft stop position.

In another embodiment, the invention provides a method of operating an exit device, the exit device including a locking mechanism for locking and unlocking a door, the locking mechanism having a link movable between locked and unlocked positions, and a motor operably connected to the link, the method comprising: operating the motor to move the link in a first direction toward the unlocked position; and thereafter operating the motor to stop the link at a soft stop position, wherein the soft stop position is between the locked position of the link and a hard stop position of the link, the hard stop position defining a position where the link is restricted from moving in the first direction.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1A:
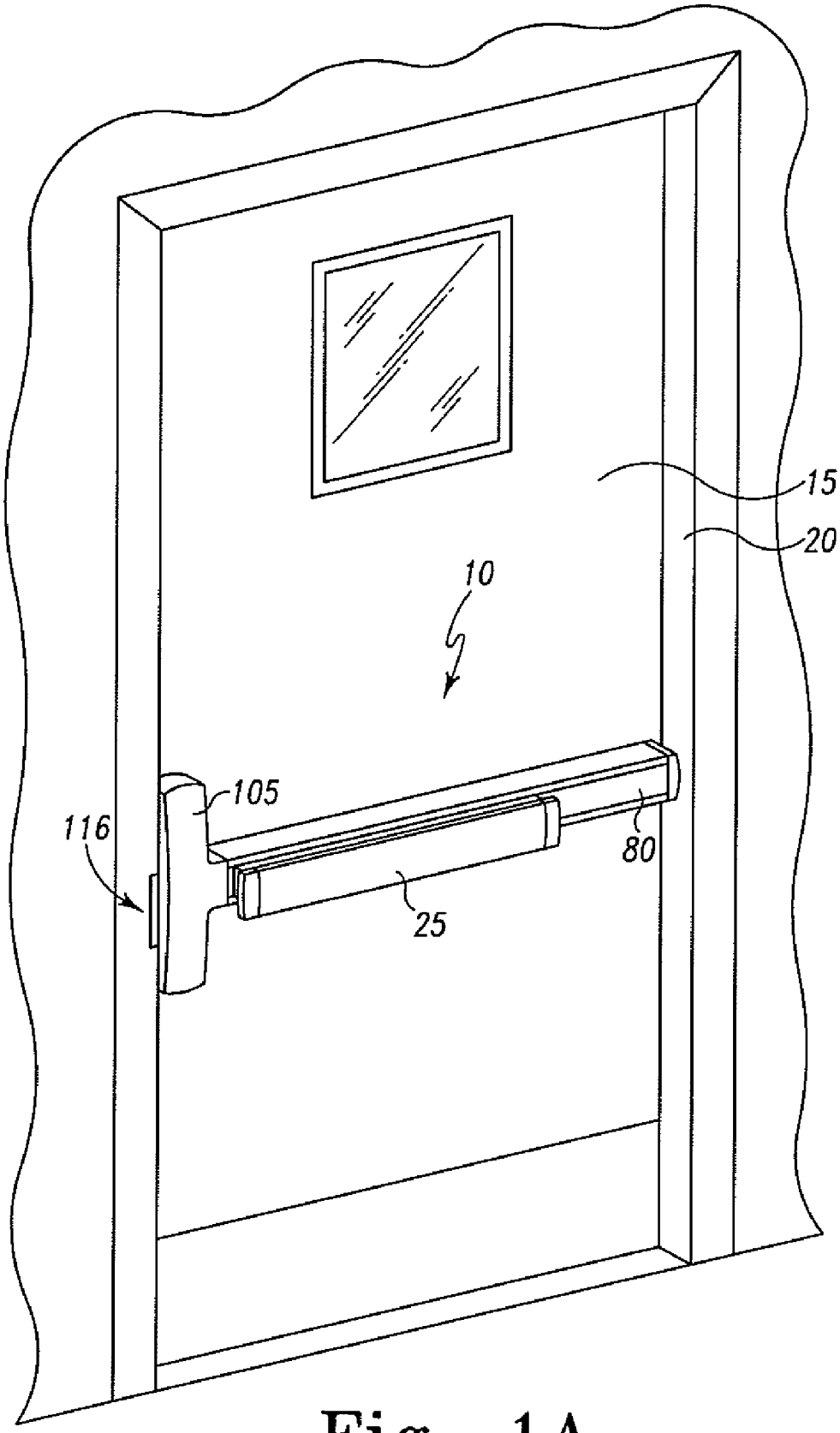
FIG. 1A illustrates an exit device mounted on a door according to one embodiment of the present invention.
Figure 1B:
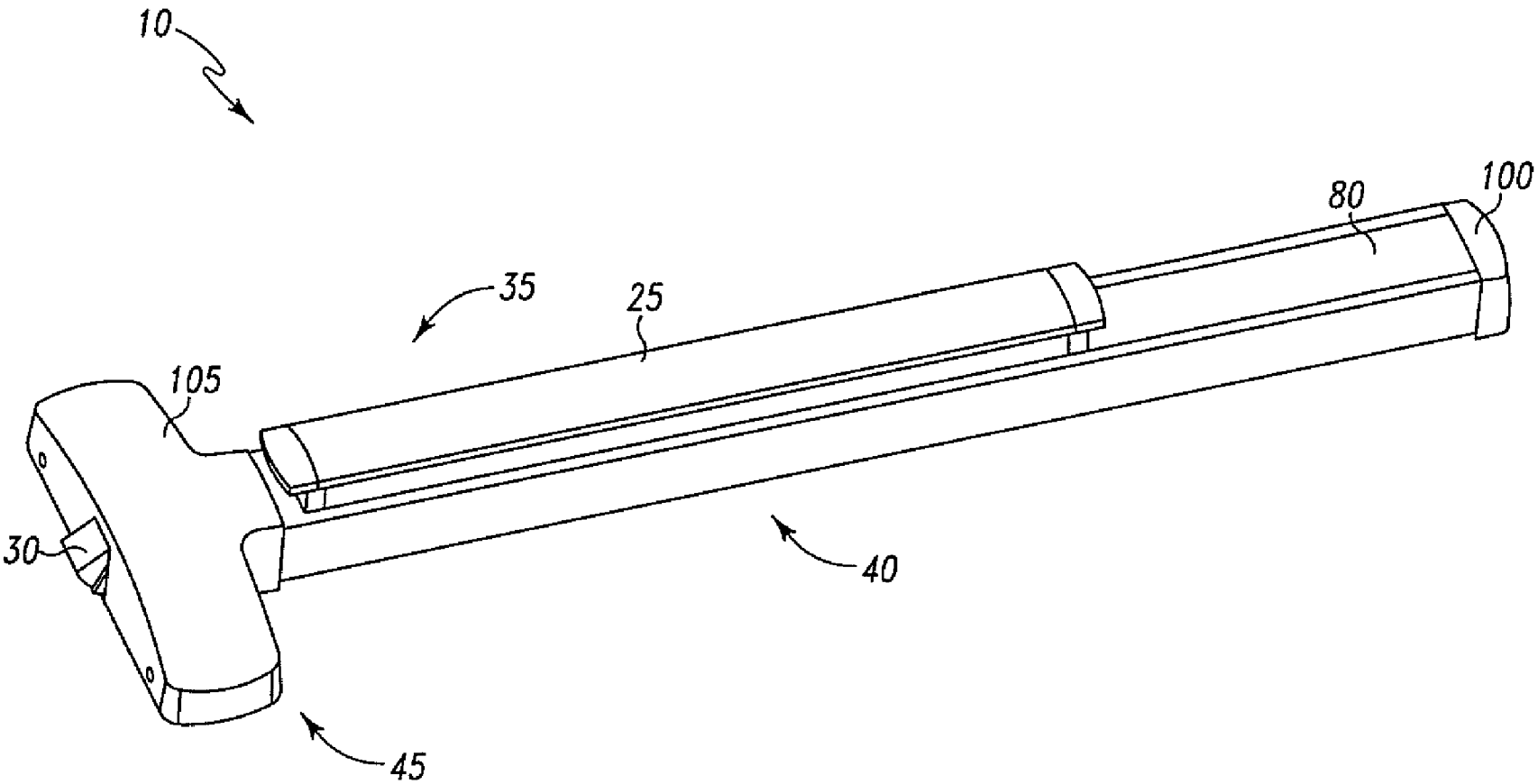
FIG. 1B illustrates the exit device of FIG. 1A with a latch bolt in an outer state.
Figure 1C:
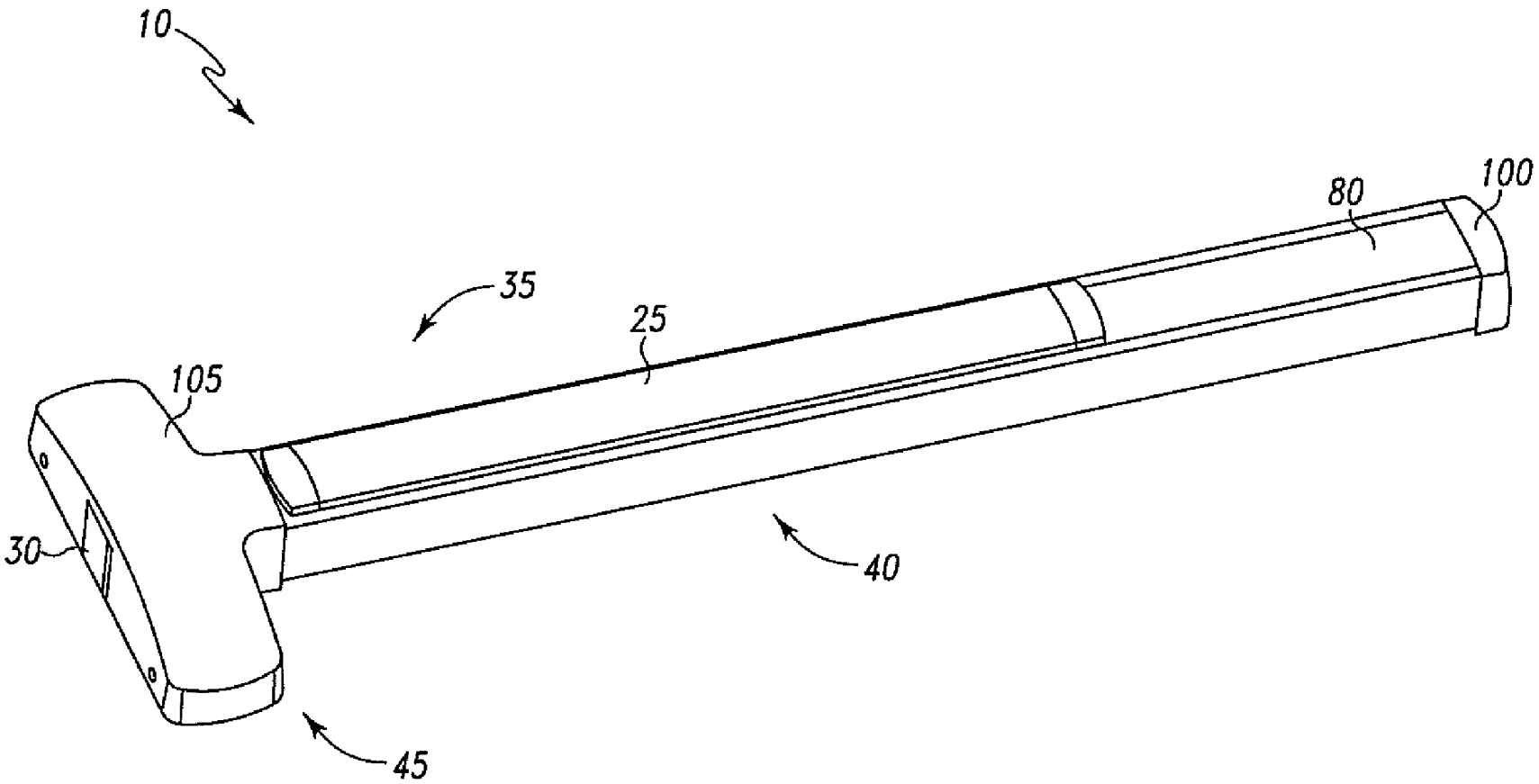
FIG. 1C illustrates the exit device of FIGS. 1A and 1B with the latch bolt in an inner state.

FIGS. 1A-1C illustrate an exit device 10 according to one embodiment of the present invention. As illustrated in FIG. 1A, the exit device 10 is mounted on the inside of a door 15 for locking and unlocking the door 15. The door 15 is generally utilized as an emergency or fire exit of a building. Particularly, the exit device 10 remains locked (in FIGS. 1A and 1B characterized by a pushbar 25 being in an outer state) preventing a person from accessing or opening the door 15 from the outside of the building. To unlock the door 15 from the inside of the building, a user merely pushes or actuates the pushbar 25 (as shown in FIG. 1C), which in turn actuates a locking mechanism (further describe below) to unlock the door 15. In the illustrated construction, a latch bolt 30 (FIG. 1B) connected to the locking mechanism extends from the exit device 10 to lock and unlock the door 15. With particular reference to FIG. 1A, the door 15 is locked when the latch bolt 30 extends from the exit device 10 and is received within a receiving aperture or against a strike on a door frame 20. The door 15 is unlocked by a user pressing the pushbar 25 (FIG. 1C), which actuates the locking mechanism to retract the latch bolt 30. This type of exit device is known in the art and need not be described in greater detail. It is to be understood that other constructions of the exit device fall within the scope of the invention.

With reference to FIGS. 1-4, the exit device 10 includes a housing 35 with a midrail portion 40 and a head portion 45. The midrail portion 40 includes a base plate 50 for coupling the exit device 10 to a door (e.g., door 15), and two side walls 55 each extending outwardly from the plate 50 and including a ledge 60. The plate 50 and the side walls 55 of the midrail portion 40 define an inner space 65 for enclosing a control system 70 (also illustrated in FIGS. 5-8) and a locking mechanism 75. The pushbar 25 is coupled to the locking mechanism 75 and is at least partially received within the inner space 65. In the illustrated construction, the pushbar 25 extends from the left end to a middle section of the midrail portion 40 (with respect to FIG. 2) and cooperates with the midrail portion 40 to substantially enclose the locking mechanism 75. The pushbar 25 includes a head portion 136 with two inwardly extending walls 137 (only one shown in FIG. 4) and end caps 138 at the ends of the pushbar 25, each end cap 138 defining a channel (not shown).

The control system 70 is located within the inner space 65 toward the right end of the midrail portion 40. A sliding plate 80 is received on the right end of the midrail portion 40 for enclosing the control system 70 in cooperation with the midrail portion 40. Accordingly, a user may access the control system 70 by at least partially sliding the plate 80 from engagement with the midrail portion 40. An end cover 100 is located on the right end of the midrail portion 40. The end cover 100 cooperates with the sliding plate 80 to enclose the control system 70 and the locking mechanism 75 in the inner space 65.

Figure 2:
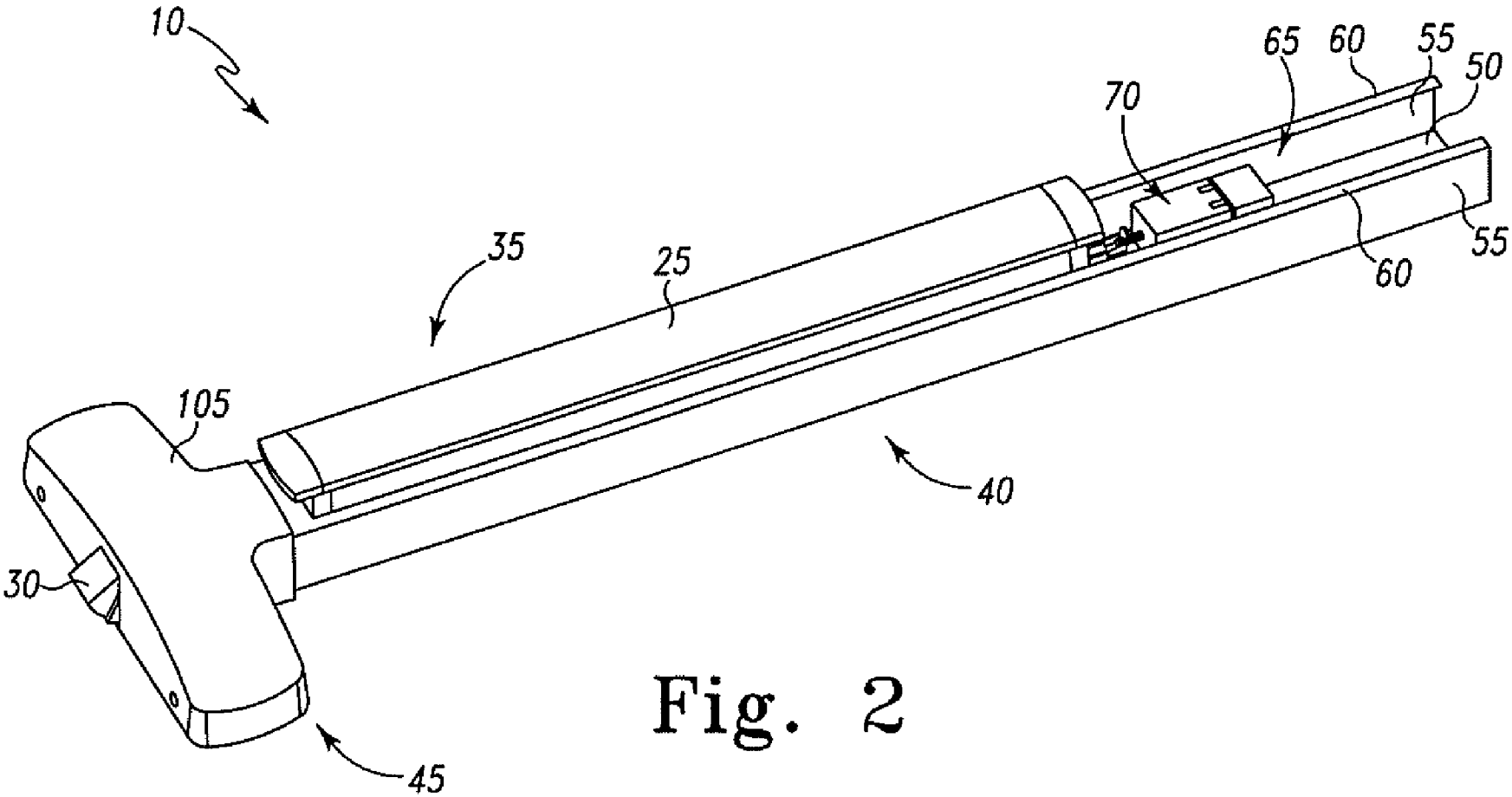
FIG. 2 illustrates a control system of the exit device.
Figure 3:
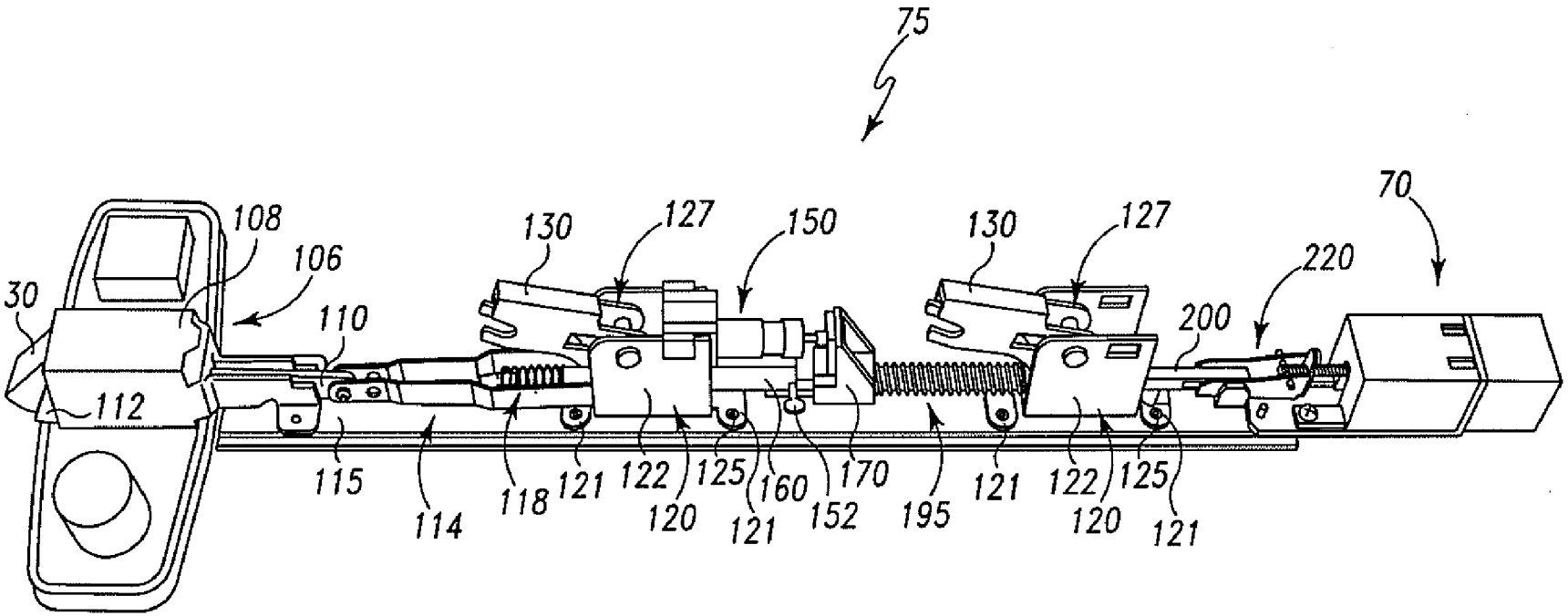
FIG. 3 illustrates the control system connected to a locking mechanism of the exit device.

With reference to FIGS. 2 and 3, the head portion 45 of the exit device 10 includes a cover 105 for enclosing a head mechanism 106 connected to the locking mechanism 75 and operable to actuate the latch bolt 30. The head mechanism 106 includes a housing 108, a locking link 110, the latch bolt 30, and an auxiliary bolt 112. The link 110 is also coupled to a shaft 160 of the locking mechanism 75 via a split link 114. The link 114 is connected to the link 110 such that the link 110 and the link 114 move together. The link 114 is connected to the shaft 160 by a lost-motion connection (not shown). A spring 118 extends between the link 114 and the end of the shaft 160 to bias the link 114 to the left relative to the shaft 160. Movement of the link 114 to the right compresses the spring 118 but does not move the shaft 160, but movement of the shaft 160 to the right pulls the link 114 to the right. This arrangement is known in the art.

The head mechanism 106 typically includes a latch bolt link (not shown) positioned within the housing 108 to couple the latch bolt 30 to the link 110. In the illustrated construction, the latch bolt 30 and the auxiliary bolt 112 extend from one end of the housing 108 opposite the link 110 to engage a strike 116 (partially illustrated in FIG. 1A). The latch bolt 30 is pivotally coupled to the housing 108 such that, when the link 110 pulls the latch bolt link, the latch bolt 30 pivots from an extended position (as shown in FIGS. 1B, 2 and 3) to a retracted position (as shown in FIG. 1C). The auxiliary bolt 112 is coupled to the latch bolt 30 for movement with the latch bolt 30 between the extended position and the retracted position. The auxiliary bolt 112 is also movable (e.g., retractable) relative to the latch bolt 30. The spring 118 and the lost-motion connection between the link 114 and the shaft 160 prevent independent inward movement of the latch bolt 30, such as when the door 15 is closed and the latch bolt 30 passes the strike 116, to transfer motion from the head mechanism 106 to the locking mechanism 75. More specifically, when the exit device 10 is in its locked position (characterized by the pushbar 25 and the latch bolt 30 being in their outer states), movement of the latch bolt 30 from its extended position (FIG. 1B) to its retracted position (FIG. 1C) compresses the spring 118 as the link 114 moves to the right relative to the shaft 160, but the motion of the link 114 is not transferred to the shaft 160. Once the latch bolt 30 is free to return to its extended position, such as after it has passed the strike 116 during closing of the door 15, the spring 118 exerts sufficient force on the link 114 to move the link 114 to the left relative to the shaft 160 and to cause the latch bolt 30 to return to its extended or outer position.

In one example, when the door 15 is closed (FIG. 1A), the latch bolt 30 is in the extended position to engage the strike 116. The auxiliary bolt 112 contacts the strike 116 such that the strike 116 pushes the auxiliary bolt 112 toward the retracted position. When the latch bolt 30 is extended and the auxiliary bolt 112 is retracted, the auxiliary bolt 112 actuates or allows actuation of a deadlock mechanism (not shown) to a position in engagement with the latch bolt 30 and/or the latch bolt link 110. In this position, the deadlock mechanism inhibits retraction of the latch bolt 30, preventing the door 15 from being forced or pushed open. When a user wishes to open the door 15, the user actuates the pushbar 25 to move the shaft 160, and thereby the link 110 to the right. As the link 110 moves to the right, the link 110 disengages the deadlock mechanism. The link 110 also pulls the latch bolt link so as to pivot the latch bolt 30 to the retracted position, allowing the door 15 to be opened.

Figure 4:
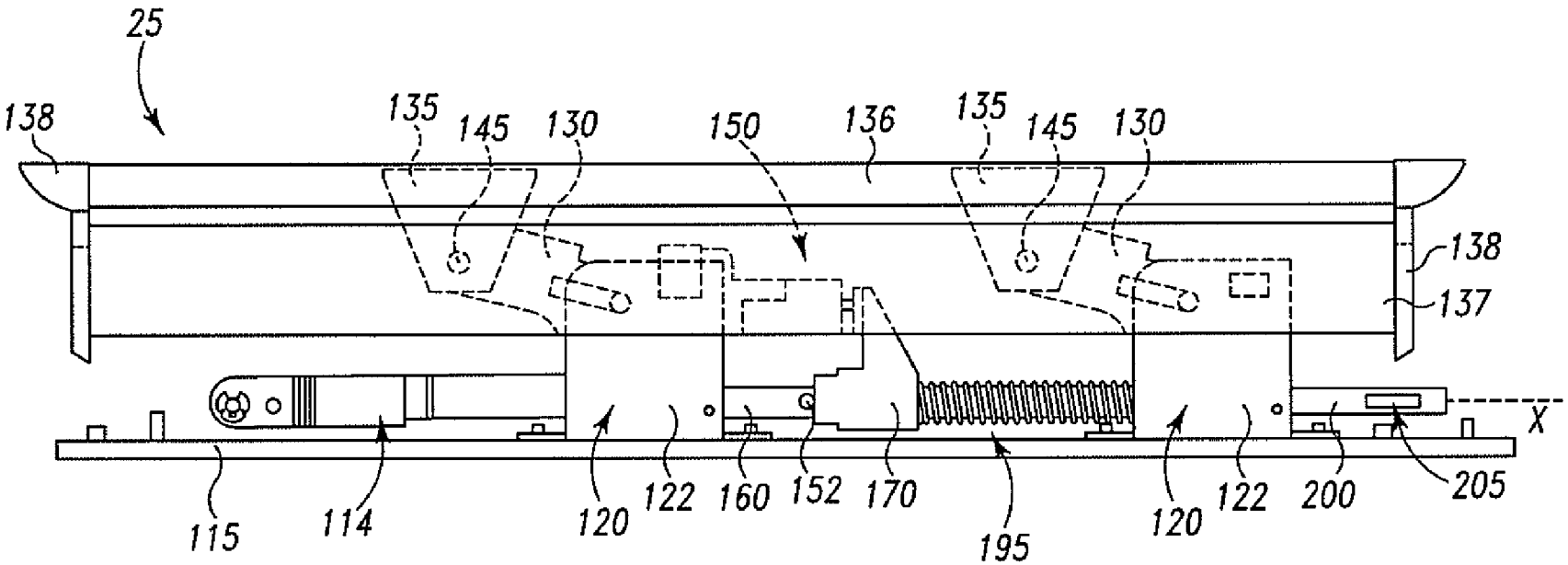
FIG. 4 illustrates a portion of the locking mechanism connected to a pushbar of the exit device.

With reference to FIGS. 3 and 4, a base plate 115 supports the locking mechanism 75 and the control system 70. The plate 115 can be coupled to the plate 50 of the midrail portion 40 by any conventional means to provide support to the locking mechanism 75 and the control system 70. The locking mechanism 75 includes two base brackets 120 fixedly coupled to the plate 115 and longitudinally spaced apart from one another in the longitudinal direction of the plate 115. Each bracket 120 includes a base portion (not shown) with extensions 121 for receiving screws 125. Each bracket 120 also includes outwardly extending wall portions 122 substantially parallel to one another and spaced along the width of the plate 115.

Each bracket 120 supports a bell crank mechanism 127 (partially illustrated in FIG. 3) including a bell crank link 130 coupled to a pushbar support bracket 135 and the shaft 160. The bell crank mechanism 127 is known by those of ordinary skill in the art and therefore will not be described in detail herein. The bell crank mechanism 127 transfers motion between the pushbar 25 and the shaft 160 upon actuation of one or the other. The pushbar 25 is mounted on the support brackets 135 and at least partially encloses the locking mechanism 75. A pin 145 couples each support bracket 135 to the associated bell crank link 130 and allows pivotal movement between the support bracket 135 and the bell crank link 130. Accordingly, inward movement (downward in FIG. 4) of the pushbar 25, and therefore of the support brackets 135, allows the bell crank mechanisms 127 to move the shaft 160 to its unlocked position.

A spring 195 is mounted on the shaft 160 between a bracket 170 and a stop (not shown) adjacent the right bracket 120. In the illustrated construction, the bracket 170 is slideably mounted on the shaft 160 and motion of the bracket 170 to the left along the shaft 160 is limited by a pin 152 extending through the shaft 160. The spring 195 exerts a force on the bracket 170 and thereby on the shaft 160 to bias the shaft 160 toward its locked position (to the left). A damping mechanism 150 extends between the left bracket 120 and the bracket 170. As indicated above, inward movement of the pushbar 25 causes movement of the shaft 160 toward the unlocked position (to the right). During movement of the shaft 160 to the right, the pin 152 moves with the shaft 160 and acts against the bracket 170 causing the bracket 170 to move to the right with the shaft 160, which causes the spring 195 to compress. When the pushbar 25 is released, the force of the spring 195 on the bracket 170 moves the shaft 160 to the left, or toward the locked position. During movement of the shaft 160 to the left, the damping mechanism 150 acts against the bracket 170 and limits the speed with which the shaft 160 moves to the left. This limits the speed of outward movement of the pushbar 25. The damping mechanism 150 does not limit the speed with which the shaft 160 moves to the right, or to the unlocked position. Thus, the pushbar 25 can be pushed in, and the door 15 unlocked, as fast as is humanly possible. Such a damping arrangement is known in the art.

Figure 5:
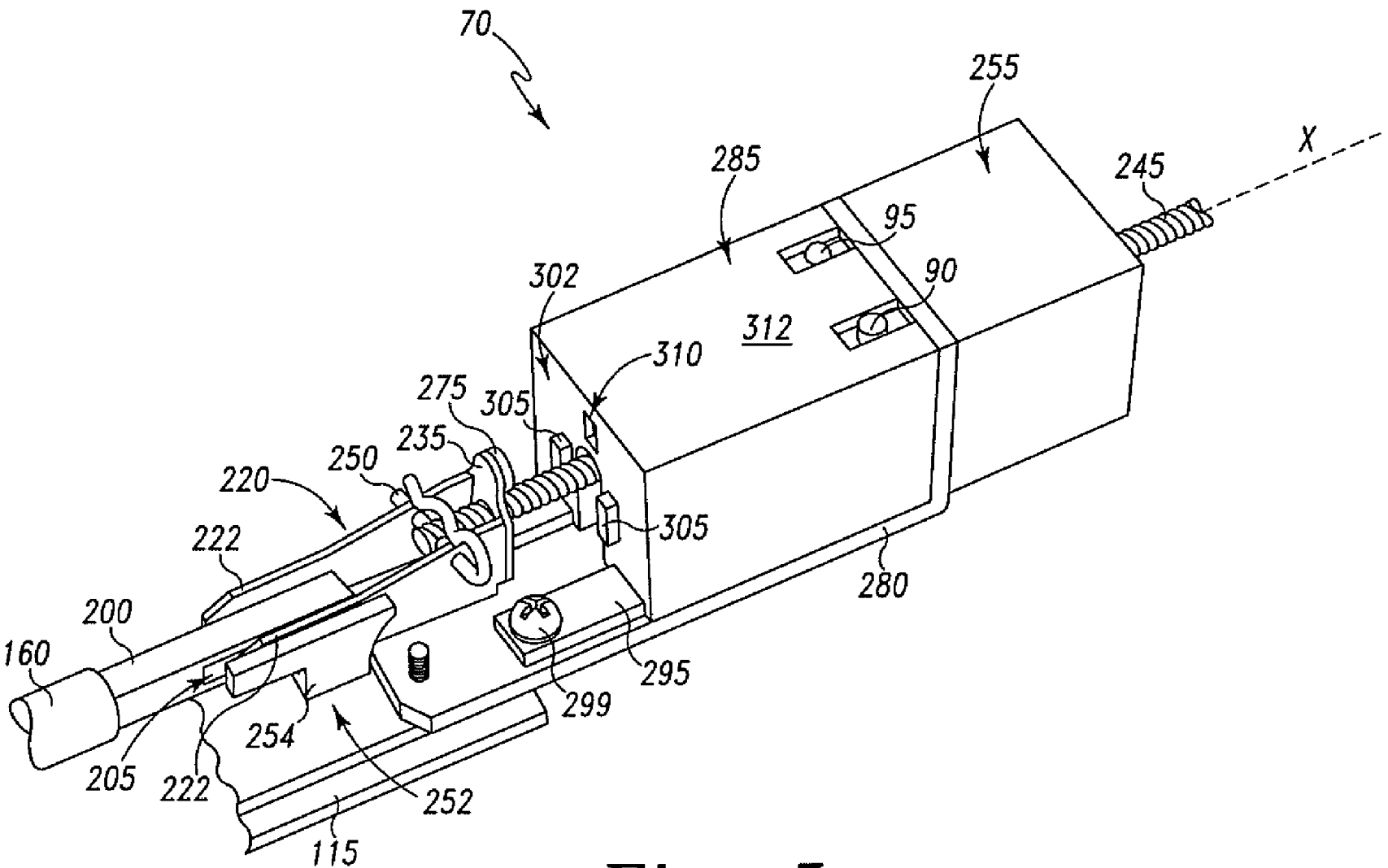
FIG. 5 illustrates the control system connected to a link of the locking mechanism in one state of the exit device.
Figure 6:
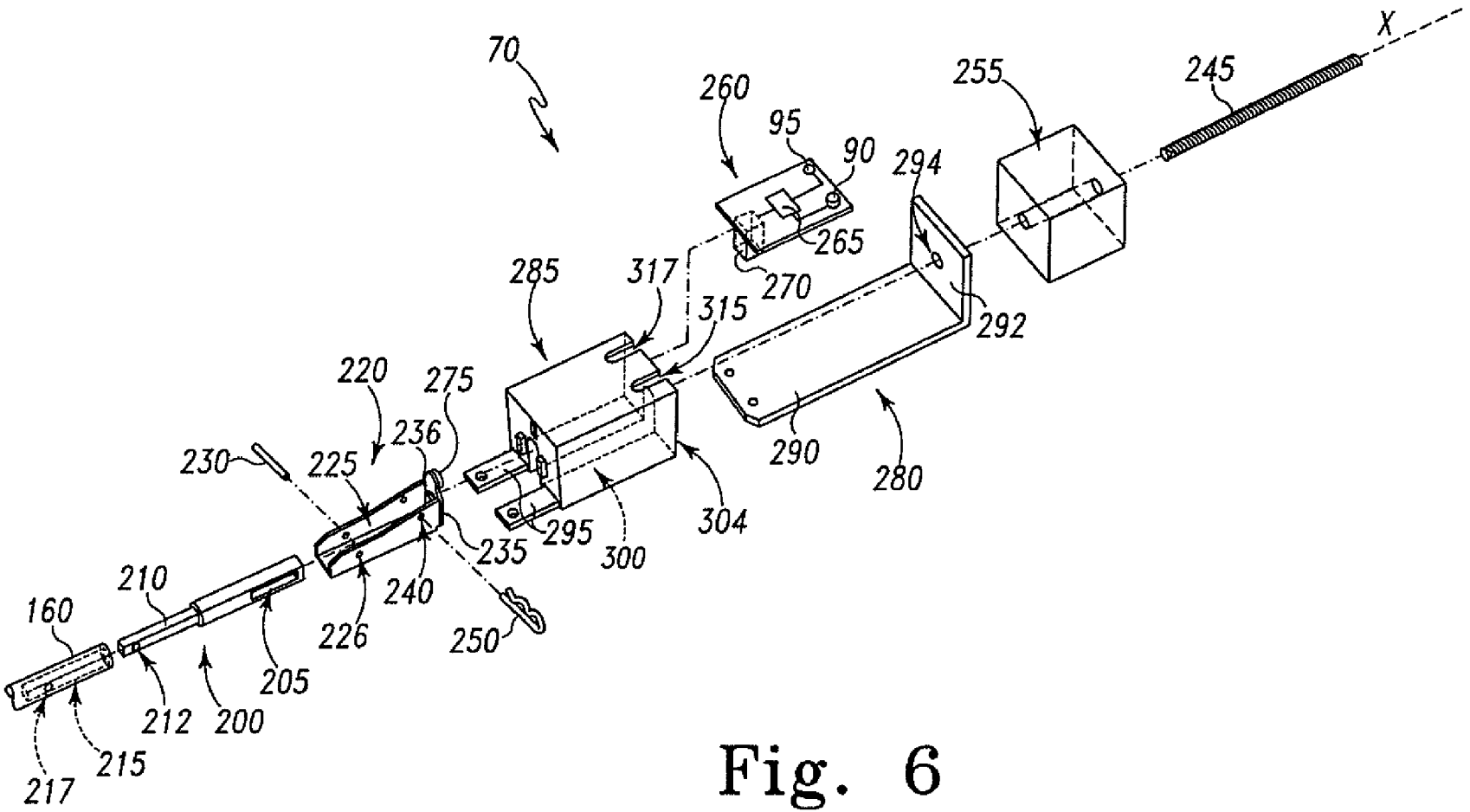
FIG. 6 illustrates the elements of the control system and the link in an exploded view.

With reference to FIGS. 4-6, a beam 200 is coupled to the right end of the shaft 160 and includes an elongated aperture or slot 205 extending from a middle section to the right end of the beam 200. The beam 200 also includes an elongated piece 210 with a through aperture 212. The piece 210 is received within an aperture 215 in the end of the shaft 160 such that the aperture 212 coincides with a through aperture 217 of the shaft 160 for receiving a pin (not shown) coupling the shaft 160 and the beam 200 to the right bell crank link 130 (FIG. 3). A drive link 220 is coupled to the beam 200 with a lost-motion connection allowing the beam 200 to move in the longitudinal direction (substantially parallel to an axis X) with respect to the link 220. The link 220 includes a bottom wall 221, a pair of substantially parallel walls 222 defining a channel 225 at least partially receiving the beam 200, and a right end wall 235 having a through aperture 236. The walls 222 include a pair of apertures 226 for receiving a pin 230, and another pair of apertures 240 for receiving a pin 250 (further explained below). When the beam 200 and the link 220 are assembled, as illustrated in FIGS. 3, 5, 7 and 8, the pin 230 is fixedly received within the apertures 226 of the link 220 and extends through the aperture 205 of the beam 200, thus allowing motion of the beam 200 with respect to the link 220 along the longitudinal axis X. A guide 252 is fixedly coupled to the plate 115 and includes outwardly extending walls 254 slideably receiving corresponding ends of the pin 230. The walls 254 are formed on opposite sides of the link 220 to help guide the link 220 along the longitudinal direction.

With reference to FIGS. 5-8, the control system 70 includes a motor 255 having an axially movable output shaft 245. The motor 255 is preferably a stepper motor such that axial movement of the shaft 245 can be measured or defined in a number of steps of the motor 255. However, other constructions of the control system 70 can include a linear motor. The output shaft 245 has external threads that threadedly engage internal threads on the rotor (not shown) of the motor 255 such that rotation of the rotor causes axial movement of the shaft 245 along the longitudinal axis X. The shaft 245 extends through, but is not threaded into, the aperture 236 of the link 220. When the link 220 and the motor shaft 245 are assembled, the pin 250 extends through the receiving apertures 240 of the link 220 and through the motor shaft 245, thus fixedly coupling the link 220 to the motor shaft 245. As further explained below, the link 220 is actuated by the motor shaft 245 to move the link 220 between locked and unlocked positions.

The control system 70 also includes a printed circuit (PC) board 260 operably connected to the motor 255 and supporting a microcontroller 265, a command signal generating mechanism actuable by a button 90, a display mechanism with LED light 95, and a sensor 270. In the illustrated construction, the sensor 270 is a Hall effect sensor and cooperates with a magnet 275 mounted on the end wall 235 of the link 220. The sensor 270 generates a voltage signal and sends the signal to the microcontroller 265. The voltage signal is indicative of the distance between the sensor 270 and the magnet 275. The voltage signal can therefore be interpreted as the position of the link 220, as further described below. The microcontroller 265 utilizes the signal from sensor 270 to operate the motor 255. The microcontroller 265 can also generate a status signal indicative of the status of the motor 255 and/or the locking mechanism 75. The control system 70 displays the status signal via LED light 95. Although a single LED element is shown in the illustrated construction, it is to be understood the control system 70 can include a number of LEDs and/or other visual displays operated by the microcontroller 265.

Figure 7:
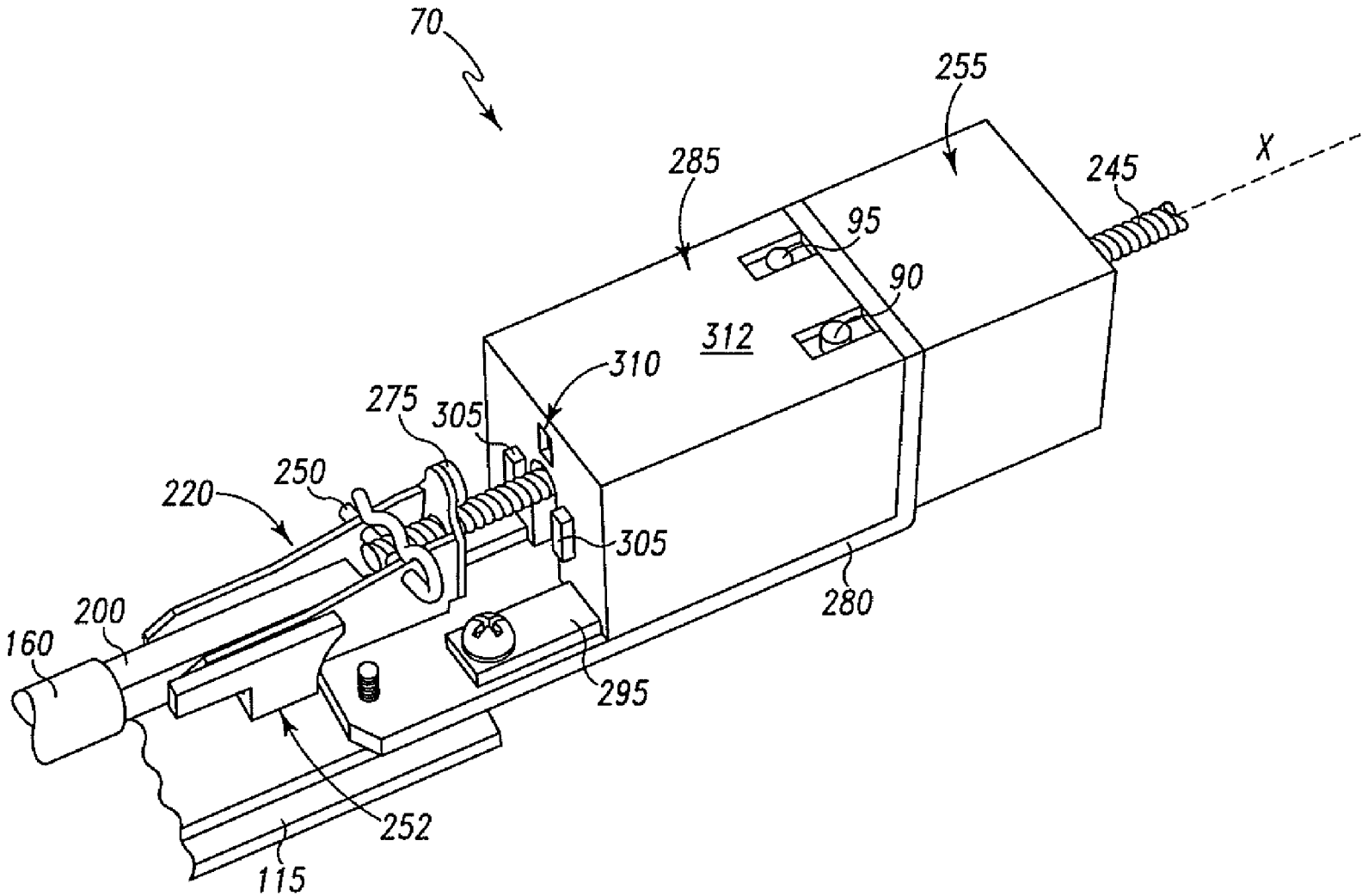
FIG. 7 illustrates the control system connected to the link in another state of the exit device.
Figure 8:
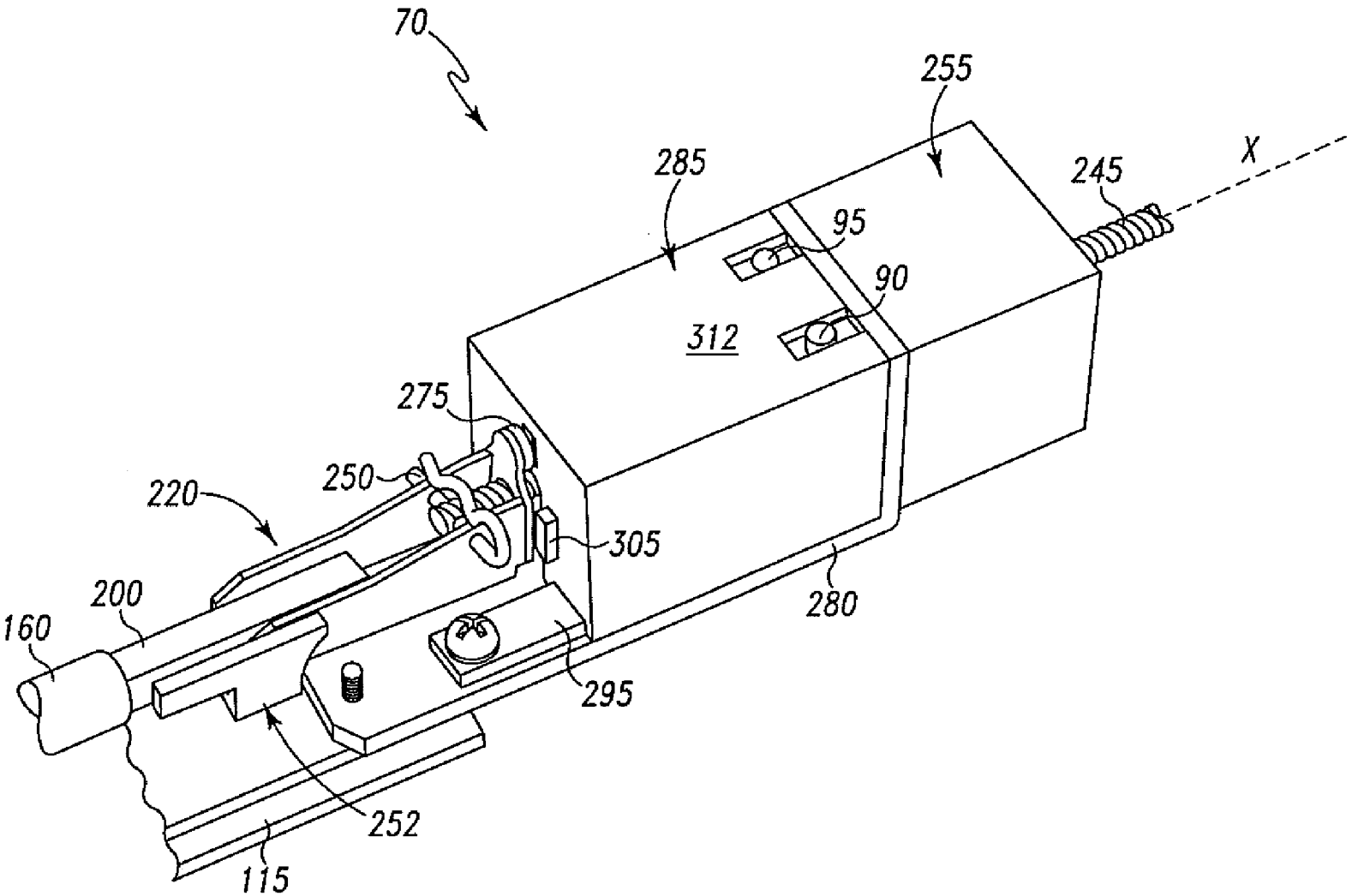
FIG. 8 illustrates the control system connected to the link in yet another state of the exit device.

A support plate 280 is fixedly coupled to the plate 115 and is operable to support the motor 255 and a housing 285 for the PC board 260. Particularly, the support plate 280 is L-shaped and includes a first portion 290 substantially parallel to the plate 115, and a second portion 292 having an aperture 294 and extending approximately at a 90 degree angle from the first portion 290. In the illustrated construction, the motor 255 is mounted on the right side of the second portion 292, opposite the first portion 290, such that the motor shaft 245 extends through the aperture 294. The housing 285 is mounted on the left side of the second portion 292, opposite the motor 255, and is fixedly coupled to the first portion 290. Particularly, the housing 285 includes a pair of arms 295 secured to the plate 280 by screws 299 (FIGS. 5, 7 and 8).

The housing 285 defines a rectangular solid having left and right ends 302 and 304. The left end 302 is defined by a wall, and the right end 304 is substantially open. In the illustrated construction, the housing 285 includes an inner space accessible via the right end 304 and includes a channel 300 extending between the ends 302 and 304. The channel 300 is defined by a wall (not shown) having the cross-sectional shape of an inverted U, and the channel 300 is aligned with the apertures 294 and 236 so that the motor shaft 245 extends through the channel 300. The first end 302 faces the link 220 and includes two protrusions or stops 305 and an inwardly extending support 310. The stops 305 are formed on opposite sides of the inverted U-shaped channel 300 and are configured to be a protective feature of the housing 285. Particularly, the stops 305 prevent the link 220 from engaging the housing 285 as a result of improper installation of the exit device 10, for example.

The support 310 engages the PC board 260 and biases the PC board 260 towards the second portion 292 of the plate 280. More specifically, the support 310 allows mounting the PC board 260 to the housing 285 without the use of glue or other coupling mechanisms for preventing movement of the PC board 260 during operation of the exit device 10. A top wall 312 of the housing 285 defines a first interface aperture or slot 315 and a second interface aperture or slot 317. The first interface aperture 315 provides access to the button 90 and the second interface aperture 317 provides access to the display or LED light 95. It is to be understood that other configurations of the housing 285 fall within the scope of the invention.

In the illustrated construction, operating the exit device 10 includes manually unlocking and dogging the exit device 10 and automatically dogging the exit device 10. Manually unlocking the exit device 10 includes operating the locking mechanism 75 by manually actuating the pushbar 25 from its outer state (FIGS. 1A, 1B) to its inner state (FIG. 1C). Although not shown, the exit device 10 can include a mechanically operated dogging device such that a user is able to "lock" the locking mechanism 75 in its unlocked position or inner state of the pushbar 25. Automatically dogging the exit device 10 includes operating the motor 255 to move the motor shaft 245 and connected elements to the right along longitudinal axis X between locked and unlocked positions, as further explained below.

During manual operation of the exit device 10, the door 15 is unlocked by inwardly pushing the pushbar 25. Inward movement of the pushbar 25 translates into movement of the shaft 160 (to the right) via the bell crank mechanisms 127. As a result, the link 114 pulls the link 110 that in turn actuates the latch bolt 30 for unlocking the door 15. Also, moving the shaft 160 to the right compresses the spring 195, thus generating a force biasing the shaft 160 to the left. The biasing force causes the shaft 160, pushbar 25 and latch bolt 30 to move to their locked or outer positions once the user releases the pushbar 25.

Moving the shaft 160 to the right also causes the beam 200 to move in the same direction. The beam 200 can move between the locked position (FIG. 5) and the unlocked position (FIG. 7) without affecting the link 220 because of the lost-motion connection between the beam 200 and the link 220. More specifically, restricted movement of the pushbar 25 and/or operation of locking mechanism 75 allows travel of the beam 200 with respect to the link 220 such that the beam 200 does not reach or engage the motor shaft 245 (FIG. 7). In the illustrated construction, inward travel of the pushbar 25 is limited by engagement of the pushbar 25 (e.g., extending walls 137 and/or end caps 138) with the plate 115 and/or one or more stops (not shown) within the exit device 10. Further, one or more stops within the exit device 10 can also restrict actuation of the locking mechanism 75 by restricting movement of one or more elements thereof in at least one direction (e.g., shaft 160 or latch bolt 30).

Figure 9:
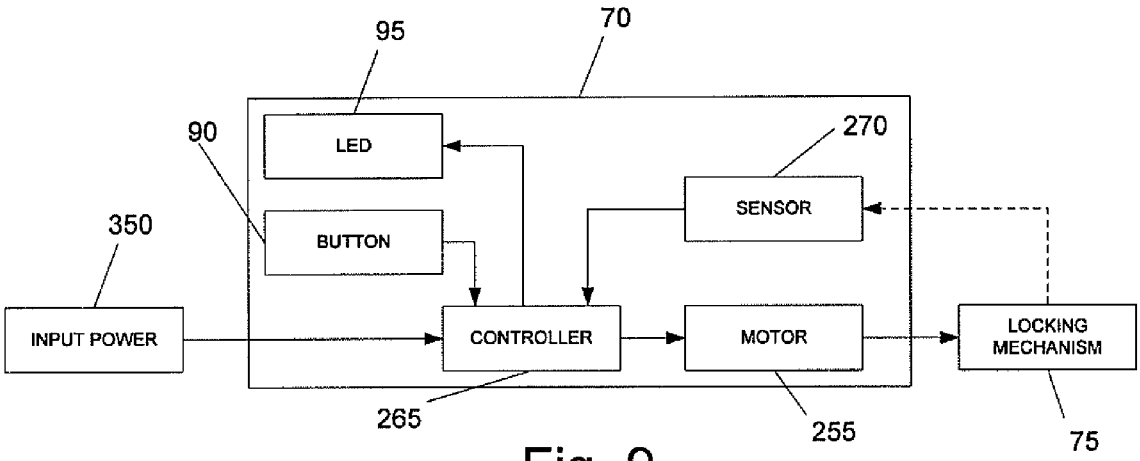
FIG. 9 is a schematic representation of the exit device illustrated in FIGS. 1-8.
Figure 10:
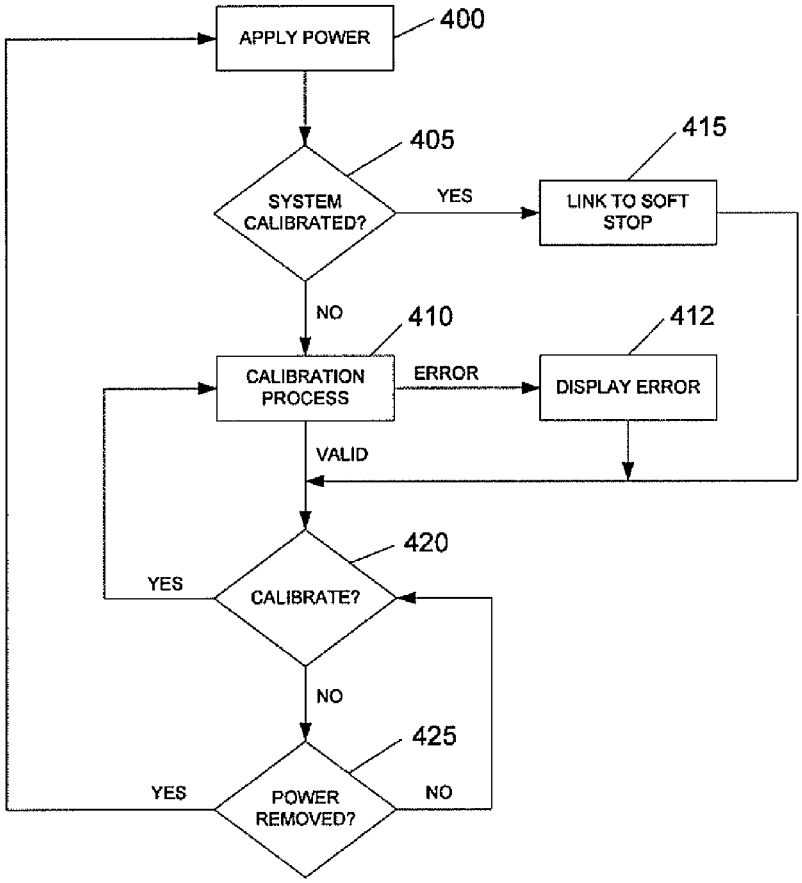
FIG. 10 illustrates a method of operating the exit device illustrated in FIGS. 1-9.

Automatic operation of the exit device 10 is described with reference to FIGS. 9 and 10. Particularly, FIG. 9 is a schematic representation of the exit device 10 connected to a power supply 350 and FIG. 10 illustrates a method of operating the exit device 10. Operation and calibration of the exit device 10 is initiated by the power supply 350 providing power to the control system 70, particularly to the microcontroller 265 (step 400). In the illustrated construction, power is not directly transmitted to the motor 255. More specifically, the microcontroller 265 administers power for the power-based functions of the exit device 10, which includes relaying power to the motor 255. The power supply 350 is an external power supply that is in turn connected to a 120/240 VAC source (not shown). It is to be understood that other conventional methods of supplying power also fall within the scope of the invention.

In addition, because power is being supplied to the control system 70, the sensor 270 is concurrently operated to detect the magnet 275 and generate a signal (sent to the microcontroller 265) indicative of the position of the link 220 through out operation and calibration of the exit device 10. Particularly, the signal generated by the sensor 270 is a voltage level measurable by the microcontroller 265. The voltage level changes as the position of the magnet 275 (and therefore of the link 220) changes with respect to the sensor 270. Accordingly, monitoring the value of the signal generated by the sensor 270 can be used to monitor the position and movement of the link 220.

Once the power supply 350 starts providing power to the control system 70 (at step 400), the microcontroller 265 proceeds to determine if the exit device 10 has been calibrated (step 405). If the device 10 has been calibrated (YES at step 405), the microcontroller 265 proceeds to automatic operation or dogging of the device 10 (step 415, described below). Generally, the microcontroller 265 is not provided with calibration data during manufacturing. Therefore, upon powering the exit device 10 for the first time, the microcontroller 265 determines that the exit device 10 has not been calibrated (NO at step 405) and proceeds to a calibration process (step 410), which will be further explained below. If the calibration process is successful, the microcontroller 265 obtains valid calibration data (e.g., data within predetermined parameters) and qualifies the calibration process as "valid." The microcontroller then proceeds to step 420. If the calibration process is not successful (some factors may cause the calibration process to fail), the microcontroller 265 sends an "error" signal to the LED light 95 for displaying the fail or error condition (step 412), and then the microcontroller proceeds to step 420. As an alternative, if the calibration process failed, and subsequent to displaying the the exit device 10 (step 410) for a number of times.

When the microcontroller 265 determines at step 405 that the exit device 10 has been previously calibrated, the controller 265 proceeds to step 415 and dogs the exit device 10 by operating the motor 255 to move the link 220 to a "soft stop" determined during the calibration process (step 410), which is explained below. Moving the link 220 to the soft stop includes the microcontroller 265 operating the motor 255 to move or retract the motor shaft 245 to the right. In the illustrated construction, moving the motor shaft 245 to the right moves the link 220 to the right, retracts the latch bolt 30 and actuates the pushbar 25 to its inner state (FIG. 1C). Concurrently, the microcontroller 265 receives a signal from the sensor 270 indicative of the position of the link 220, as described above. The microcontroller 265 stops the motor 255 when the value of the signal is substantially equal to the value indicative of the soft stop, also defined as a soft stop value. This is further explained below. Further, operating the motor 255 to move the link 220 to the soft stop includes applying a first power to the motor 255. The microcontroller 265 provides or relays a second power to the motor 255 for stopping movement of the link 220 and maintaining the link 220 at the soft stop. In other words, applying the second power to the motor 255 to maintain the link 220 at the soft stop effectively dogs the exit device 10. Generally, the first power for moving the motor shaft 245 is greater than the second power. However, the microcontroller 265 can vary the first power and the second power based on environmental conditions or attempts to tamper with the exit device 10, for example. After step 415, the controller 265 goes to step 420.

Subsequent to the calibration process (at step 410), and whether or not calibration was successful, the microcontroller 265 proceeds to step 420 and determines if there is a command to calibrate the exit device 10. In the illustrated construction, the command to calibrate the exit device 10 is generated by a user actuating the button 90. If the initial calibration was not successful, the user will see the error signal and should give the command to calibrate. Otherwise, step 420 allows the user to optionally recalibrate the exit device 10 if the conditions of use have changed from when the exit device 10 was first calibrated, for example. If there is a command to calibrate (YES at step 420), the controller returns to step 410. If there is no command to calibrate, the controller proceeds to step 425.

At step 425, after a NO at step 420, the microcontroller 265 determines if power has been removed. In other words, the microcontroller 265 determines if power supply 350 stops supplying power to the control system 70. The user would be expected to remove the power after initial calibration. Otherwise, the power will remain on as long as the device is being dogged. If at step 425 power has not been removed, the microcontroller 265 loops between the previously described step 420 (command to calibrate?) and step 425 (power removed?). If at step 425 power has been removed, the controller returns to step 400 and waits for power to be applied again. Removing power from the control system 70 allows the motor shaft 245 to move with respect to the motor 255 under an external influence. More specifically, the spring 195 biases the shaft 160 (thus pulling the link 220 and motor shaft 245) to the left causing the latch bolt 30 to extend outwardly from the exit device 10 (FIG. 1B). In addition, moving the shaft 160 to the left causes the pushbar 25 to return to its outer state. Automatically operating or dogging the exit device 10 initiates when power is again supplied to the control system 70 (at step 400).

Figure 11:
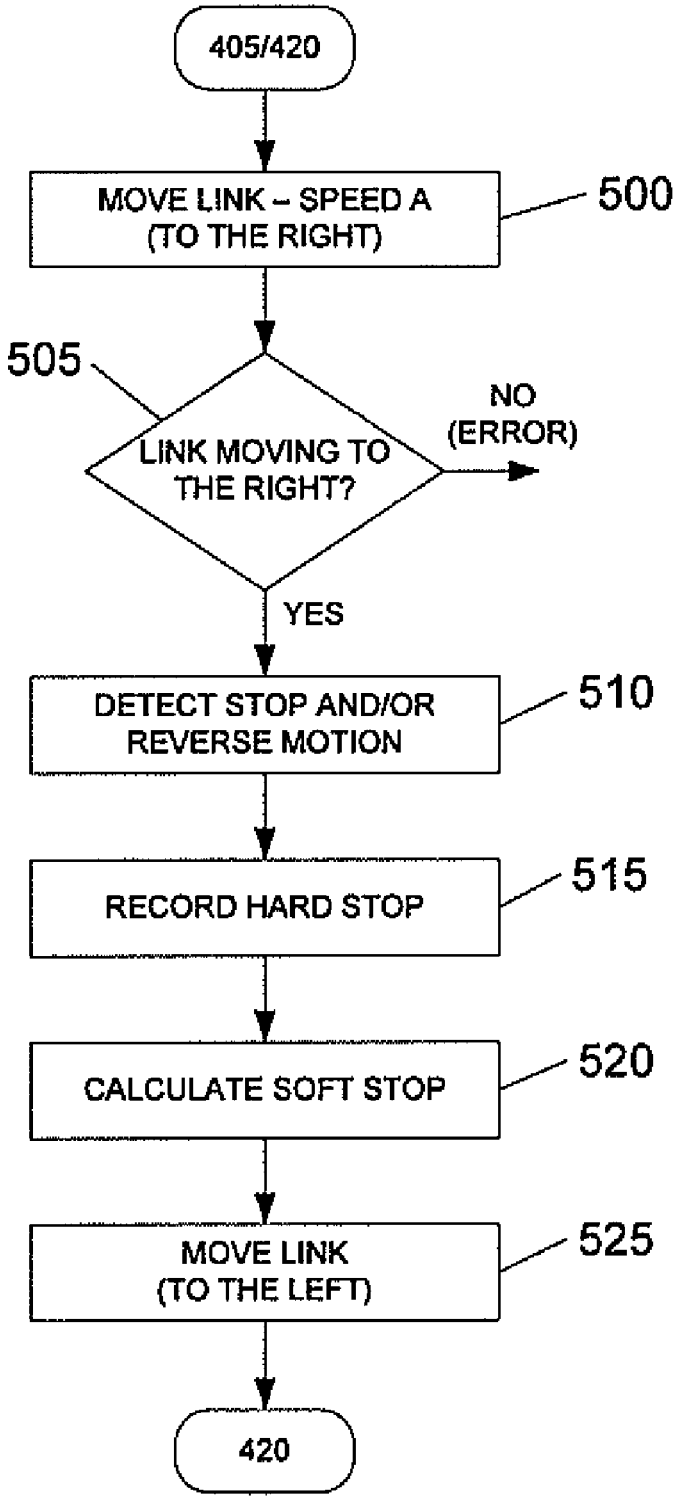
FIG. 11 illustrates a first implementation of a calibration process described with respect to FIG. 10.
Figure 12:
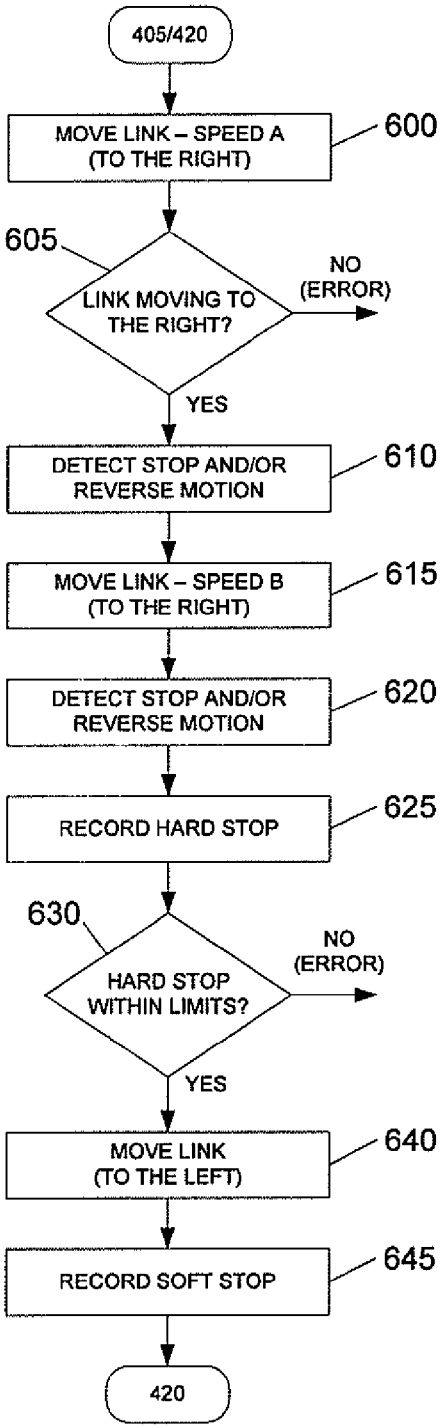
FIG. 12 illustrates a second implementation of the calibration process described with respect to FIG. 10.
Figure 13:
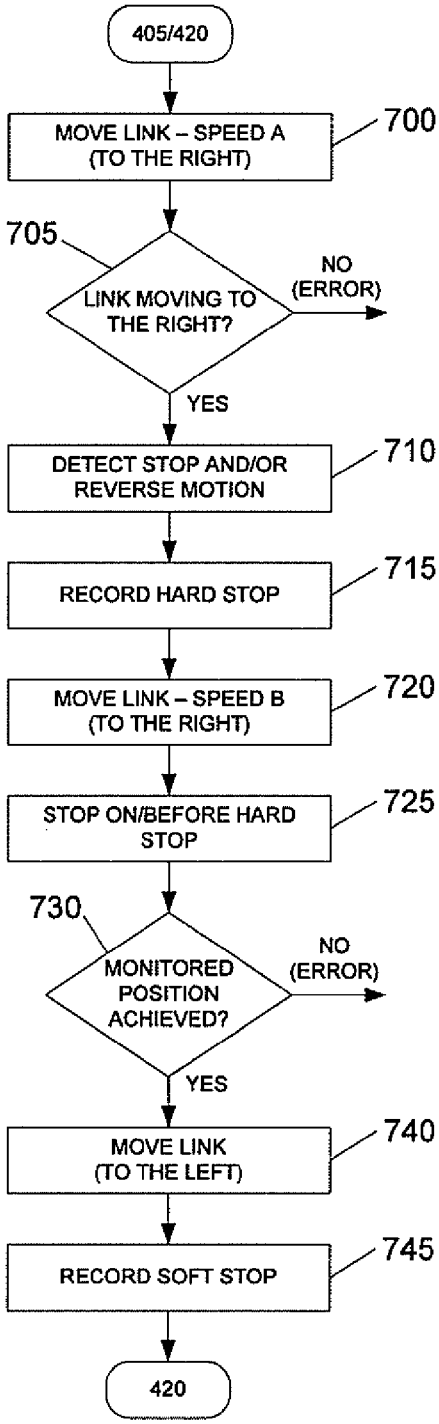
FIG. 13 illustrates a third implementation of the calibration process described with respect to FIG. 10.

FIGS. 11-13 illustrate three alternative calibration processes 410. In general, the calibration process allows for proper operation of the exit device 10 with the motor 255, particularly when the motor 255 is a stepper motor, which in turn results in a reduction of noise and wear of the exit device 10. The calibration process allows the microcontroller 265 to record calibration data for affecting subsequent operation of the exit device 10, as described in FIG. 10 for example. The calibration process is particularly advantageous because it allows calibrating the exit device 10 at a manufacturing facility or preferably after installation (on the door 15, for example) with minimal user interaction. In addition, the calibration process is generic and permits utilizing the control system 70 in different types of exit devices. In other words, the control system 70 may be installed in an exit device different than the exit device 10 because the calibration process provides instructions for sensing features and recording data that characterize the exit device.

FIG. 11 illustrates a first alternative implementation of the calibration process 410 (FIG. 10) subsequent to the microcontroller 265 determining the exit device 10 needs to be calibrated for the first time (at step 405) or recalibrated (at step 420). In this implementation, at step 500 the microcontroller 265 operates the motor 255 to move the link 220 at a speed A (about one inch/sec) in a first direction or to the right, with respect to FIGS. 3 and 4. The microcontroller 265 then determines at step 505 if the link 220 is in fact moving to the right as a result of operating the motor 255. More specifically, the microprocessor 265 determines if the value of the signal generated by the sensor 270 is indicative of an expected travel distance of the link 220 to the right. In the case of a stepper motor, a predetermined number of "steps" yields the expected distance. Wrongly installing the exit device 10 or an obstruction affecting the locking mechanism 75 can prevent the link 220 from moving the expected distance. As a result of the link 220 not moving the expected distance, the microcontroller 265 terminates the calibration process and generates an error signal, as described with respect to FIG. 10. In preferred constructions, the microcontroller 265 can reinitiate the calibration process a predetermined number of times (e.g., three times) prior to terminating the calibration process.

When the microcontroller 265 determines at step 505 that the link 220 travels a distance substantially equal to the expected travel distance to the right, the microcontroller 265 continues operating the motor 255 to move the link 220 to the right. Eventually, the link 220 ceases movement at a "hard stop." In the illustrated construction, the hard stop is a position of the link 220 where the link 220 is restricted from further moving to the right. More specifically, movement of the link 220 is restricted as a result of the pushbar 25 or an element of the locking mechanism 75 engaging an obstruction or stop (not shown) within the exit device 10. Moving the link 220 at the speed A causes the pushbar 25 and/or the element of the locking mechanism 75 to travel at a relatively fast speed as well. As a consequence, the pushbar 25 and/or the element of the locking mechanism 75 may bounce off the stop, resulting in the link 220 moving a distance in a second direction or to the left from the hard stop.

The sensor 270 generating the signal indicative of the position of the link 220 allows the microcontroller 265 to detect the link 220 stopping or ceasing movement to the right and reversing or moving to the left (step 510). When this happens, the motor 255 is stopped and the microcontroller 265 proceeds to record the value indicative of the hard stop, also identified as the hard stop value (step 515). More specifically, the recorded value is the maximum value of the signal generated by the sensor 270 between the link 220 moving to the right and then moving to the left. Subsequent to recording the hard stop value (at step 515), the microcontroller 265 calculates the soft stop value (step 520). More specifically, the microcontroller 265 subtracts an adjustment value from the recorded hard stop value to determine the soft stop value. In some constructions, the adjustment value is a voltage value indicative of a distance. In other constructions, the adjustment value is a distance related to a predetermined number of steps of the stepper motor. In yet other embodiments, the adjustment value can be calculated by the microcontroller 265 based on one or more parameters of the exit device 10.

Subsequent to the microcontroller 265 calculating the soft stop value (at step 520), the microcontroller 265 operates the motor 255 to move the link 220 to the left at a retract speed of about 0.25 inch/sec (step 525). In some constructions, the microcontroller 265 instructs the motor 255 to move the link 220 to the locked position (FIG. 5). In other constructions, the microcontroller 265 instructs the motor 255 to stop the link 220 at the soft stop for dogging the exit device 10. This completes the calibration process, and the microcontroller 265 then proceeds with step 420 as described with reference to FIG. 10. The implementation of the calibration process in FIG. 11 generally provides the quickest method of finding the hard stop in comparison to the alternative implementations described herein.

FIG. 12 illustrates a second alternative implementation of the calibration process. In the second alternative implementation, the microcontroller 265 operates the motor 255 to move the link 220 at a speed A (about one inch/sec) to the right (step 600). The microcontroller 265 then determines at step 605 if the link 220 is moving to the right as a result of operating the motor 255. This is similar to step 505 of FIG. 11.

When the microcontroller 265 determines the link 220 travels a distance substantially equal to the expected travel distance (at step 605), the microcontroller 265 continues operating the motor 255 to move the link 220 to the right. Eventually, as explained above, the link 220 reaches the hard stop and moves a distance to the left. This is detected at step 610. Thereafter, the microcontroller 265 operates the motor 255 to move the link 220 to the right at a slower approach speed B of about 0.25 inch/sec until the link 220 reaches the hard stop (step 615). In some cases, the motor 255 may continue to bias the link 220 to the right, causing the motor 255 to slip. If the motor 255 slips, the link 220 moves a relatively small distance to the left. At step 620 the sensor 270 detects the link 220 stopping or ceasing movement to the right and reversing or moving to the left if the motor 255 slips. Then the motor 255 is stopped and the microcontroller 265 proceeds to record the hard stop value (step 625). To avoid recording an erroneous hard stop value, the microcontroller 265 compares the recorded hard stop value to previously determined or recorded upper and lower limits (step 630). If the recorded hard stop value is not within the upper and lower limits, the microcontroller 265 terminates the calibration process and generates an error signal, as described with respect to FIG. 10.

When the microcontroller 265 determines the recorded hard stop value is within the upper and lower limits (at step 630), the microcontroller 265 operates the motor 255 to move the link 220 to the left at the retract speed of about 0.25 inch/sec (step 640). The motor 255 moves the link 220 a distance related to a predetermined number of steps of the stepper motor 255. In other embodiments, the distance to retract the link 220 may be related to a value prerecorded in the microcontroller 265. In yet other embodiments, the microcontroller 265 can calculate the distance to retract the link 220 based on one or more parameters of the exit device 10. The microcontroller 265 then stops the motor 255 and records the soft stop value (step 645). In some constructions, the microcontroller 265 instructs the motor 255 to move the link 220 to the locked position subsequent to recording the soft stop value (FIG. 5). In other constructions, the microcontroller 265 instructs the motor 255 to maintain the link 220 at the soft stop for dogging the exit device 10. The microcontroller 265 then proceeds with step 420 as described with reference to FIG. 10. The implementation of the calibration process in FIG. 12 generally provides the most accurate method of finding the hard stop in comparison to other alternative implementations described herein.

FIG. 13 illustrates a third alternative implementation of the calibration process. Steps 700, 705 and 710 are identical to steps 600, 605 and 610, respectively. After step 710, when the link 220 ceases movement to the right, the motor 255 is stopped and the microcontroller 265 proceeds to record the hard stop value (step 715). Particularly, the recorded value is the maximum value of the signal generated by the sensor 270 between the link 220 moving to the right and then moving to the left.

Thereafter, the microcontroller 265 operates the motor 255 to move the link 220 to the right at an approach speed B of about 0.25 inch/sec (step 720). The microcontroller 265 operates the motor 255 to move the link 220 until the signal generated by the sensor 270 is substantially equal to the hard stop value minus a relatively small delta value (step 725). Accordingly, at step 730 the microcontroller 265 monitors movement of the link 220 and determines if the value of the signal generated by the sensor 270 is sufficiently close to the recorded hard stop value. If the signal generated by the sensor 270 is not sufficiently close to the recorded hard stop value, the microcontroller 265 terminates the calibration process and generates an error signal, as described with respect to FIG. 10.

When the microcontroller 265 determines at step 730 that the signal generated by the sensor 270 is sufficiently close to the recorded hard stop value, the microcontroller 265 operates the motor 255 to move the link 220 to the left at the retract speed of about 0.25 inch/sec (step 740). The motor 255 moves the link 220 a distance related to a predetermined number of steps of the stepper motor 255. The microcontroller 265 then stops the motor 255 and records the soft stop value (step 745). In some constructions, the microcontroller 265 instructs the motor 255 to move the link 220 to the locked position subsequent to recording the soft stop value (FIG. 5). In other constructions, the microcontroller 265 instructs the motor 255 to maintain the link 220 at the soft stop for dogging the exit device 10. The microcontroller 265 then proceeds with step 420 as described with reference to FIG. 10. The implementation of the calibration process in FIG. 13 generally provides a slightly faster method of finding the hard stop with minimal loss of accuracy, in comparison to the alternative implementation described with respect to FIG. 12.

Operating the exit device 10 with the control system 70 provides the exit device 10 with a number of advantageous features adding functionality to the exit device 10. Some of these features include, but are not limited to anti-tampering procedures, procedures for reacting to external and/or environmental agents, response to door slam conditions and procedures for operating the exit device 10 from an unknown position.

The anti-tampering procedures allow for automatic operation of the exit device 10 in response to a person disrupting the normal operation of the exit device 10. Tampering can take various forms. In one example, a person can attempt to actuate the pushbar 25 from the inner state to the outer state of the pushbar 25 while the exit device 10 is in its unlocked position. In another example, a person can place an object on the exit device 10 for preventing the pushbar 25 from moving from the outer state to the inner state when the control system 70 is in the process of dogging the exit device 10.

While power is relayed from the power supply 350 to the control system 70, the signal generated by the sensor 270 is utilized to detect tampering attempts. More specifically, based on the signal generated by the sensor 270, the microcontroller 265 can determine if the pushbar 25 is not moving to its inner state, when the microcontroller 265 is operating the motor 255 for dogging the exit device 10, or if the pushbar 25 is forced out from its inner state subsequent to dogging the exit device 10. In response to the microcontroller 265 detecting a tampering event, the microcontroller 265 can operate the motor 255 to retract the link 220, which in turn retracts the locking mechanism 75 and pushbar 25. Further, in response to continuous tampering attempts, the microcontroller 265 operates the motor 255 a predetermined number of times (e.g., three times) for retracting the pushbar 25. If the tampering attempts continue subsequent to the motor 255 retracting the pushbar 25 the predetermined number of times, the microcontroller 265 stops operating the motor 255 for a predetermined period of time (e.g., 2 minutes). The microcontroller 265 operates the motor 255 as described above until the tampering attempts stop, as long as power is relayed to the control system 70 from the power source 350. The anti-tampering procedures prevent the motor 255 from overheating and reduce the noise generated by the exit device 10.

The procedures for reacting to external and/or environmental agents allow operation of the exit device 10 in response to preloading conditions that may prevent normal operation of the exit device 10. Particularly, installation conditions of the exit device 10 on a door (e.g., door 15) can subject the latch bolt 30 to various forces that would help prevent the latch bolt 30 from retracting when power is applied to the control system 70 to operate the exit device 10. Three examples of such conditions are (a) the door 15 is tightly fitted in the frame 20 causing a weather strip (not shown) mounted on the door 15 to put a preload on the latch bolt 30, (b) the difference in air pressure between the inside and outside air causing pressure to be exerted on the door 15 and thus putting a preload on the latch bolt 30, and (c) a person attempting to pull the door 15 open prior to the latch bolt 30 being retracted (for dogging the exit device 10, for example), which results in a latch bolt preload.

While power is relayed from the power supply 350 to the control system 70, the signal generated by the sensor 270 is utilized to detect preload conditions of the latch bolt 30. More specifically, based on the signal generated by the sensor 270, the microcontroller 265 can determine if the locking mechanism 75 is not moving to its unlocked position due to the preload condition of the latch bolt 30, for example. Further, the microcontroller 265 can track the amount of time of the locking mechanism 75 being prevented from moving to its unlocked position. After a predetermined period of time, the microcontroller 265 can operate the motor 255 to move the locking mechanism 75 a predetermined number of times (e.g., 3 times), which in turn retracts the latch bolt 30. In the event the motor 255 is unable to move the locking mechanism 75 to its unlocked position after the predetermined number of times, the microcontroller 265 ceases to operate the motor 255. This procedure helps prevent overheating the motor 255 and damage to the exit device 10 by continuously attempting to move the locking mechanism 75 to its unlocked position as long as power is relayed to the control system 70.

The procedures for responding to door slam conditions allow operation of the exit device 10 in cases when the unlocked door 15 (due to dogging the exit device 10) is forcedly manipulated. In one example, the door 15 is slammed against the frame 20 causing the locking mechanism 75 to release the latch bolt 30 from its retracted position and to move the pushbar 25 to its outer state. Particularly, the locking mechanism 75 releasing the latch bolt 30 and pushbar 25 may be caused by the inertia and mass of the exit device 10 stopping abruptly and the locking mechanism 75 overcoming the holding force of the motor 255.

While power is relayed from the power supply 350 to the control system 70, the signal generated by the sensor 270 is utilized to detect a change in the position of the link 220, which is connected to the locking mechanism 75, while the microcontroller 265 is controlling the motor 255 to maintain the exit device 10 unlocked. In response to the door slam condition, the microcontroller 265 relays a locking power to the motor 255 (similar to the second power for maintaining the exit device 10 unlocked) for a predetermined amount of time (e.g., 100 ms) to endure the slam condition. Subsequently, the microcontroller 265 relays a retracting power to the motor 255 (higher than the locking power) to reposition the locking mechanism 75 to its locked position, thus retracting the latch bolt 30, moving the pushbar 25 to its inner state and moving the link 220 to the soft stop. Subsequent to the door slam condition, a person may attempt to pull the pushbar 25 to its outer state. In response to microcontroller 265 detecting this particular event, the microcontroller 265 can stop relaying power to the motor 255 to prevent damage to the exit device 10.

Calibrating the exit device 10, as previously discussed, can prevent malfunction or damage to the exit device 10 when the pushbar 25 is moved out of place with respect to the original position of the pushbar 25 when the exit device 10 is first installed. More specifically, the pushbar 25 could have been placed further out or in from its outer state prior to relaying power to the control system 70 for dogging the exit device 10. In an exit device without the calibrating feature, the travel distance of the locking mechanism 75 to unlock the door 15 may be affected. For example, when power is applied to the control system 70, the locking mechanism 75 can engage a stop causing the link 220 to bounce off to an unknown position. In another case, the locking mechanism 75 may not retract the latch bolt 30 sufficiently to unlock the door 15. However, as a result of the calibration process of the exit device 10, the control system 70 operates the locking mechanism 75 to the soft stop when dogging the exit device 10 regardless of the starting position of the pushbar 25.

Various features and advantages of the invention are set forth in the following claims.

What is claimed is:

1. A method of operating an exit device, the exit device including a locking mechanism for locking and unlocking a door, the locking mechanism having a latch bolt movable between an extended state and a refracted state, and a link connected to the latch bolt and movable between locked and unlocked positions, movement of the link between the locked and unlocked positions causing movement of the latch bolt between the extended state and the retracted state to lock and unlock the door, and a motor operably connected to the link, the method comprising:

operating the motor to move the link in a first direction toward the unlocked position, the motor being operated until the link reaches a hard stop position;

thereafter determining a soft stop position based on the hard stop position; and thereafter selectively using the motor to move the link in the first direction toward the unlocked position, the motor being operated only until the link reaches the soft stop position.

2. The method of claim 1, further comprising generating a signal indicative of the position of the link, and subsequent to the link reaching the hard stop position, recording a hard stop value of the signal indicative of the hard stop position.

3. The method of claim 2, wherein determining the soft stop position includes subtracting a first value from the hard stop value to calculate a soft stop value.

4. The method of claim 1, wherein operating the motor to move the link in the first direction includes moving the link at a first speed until the link reaches the hard stop position causing the link to move in a second direction opposite the first direction, the method further comprising generating a signal indicative of the position of the link, subsequent to the link moving in the second direction, operating the motor to move the link at an approach speed in the first direction until the link reaches the hard stop position, the first speed being greater than the approach speed, and thereafter recording a hard stop value of the signal indicative of the hard stop position.

5. The method of claim 4, further comprising operating the motor to move the link in the second direction a first distance, wherein determining the soft stop position includes recording a soft stop value of the signal indicative of the soft stop position subsequent to operating the motor to move the link the first distance.

6. The method of claim 1, wherein operating the motor to move the link in the first direction includes moving the link at a first speed until the link reaches the hard stop position causing the link to move in a second direction opposite the first direction, the method further comprising generating a signal indicative of the position of the link, subsequent to the link moving in the second direction, recording a hard stop value of the signal indicative of the hard stop position, and thereafter operating the motor to move the link in the first direction at an approach speed until the value of the signal is substantially equal to the hard stop value minus a delta value, the first speed being greater than the approach speed.

7. The method of claim 6, further comprising operating the motor to move the link in the second direction a first distance, wherein determining the soft stop position includes recording a soft stop value of the signal indicative of the soft stop position subsequent to operating the motor to move the link the first distance.

8. The method of claim 1, wherein the motor is a stepper motor.

9. The method of claim 1, wherein the exit device further comprises a pushbar operable between an outer state and an inner state, the pushbar connected to the locking mechanism such that movement of the pushbar from the outer state to the inner state causes the latch bolt to move from the extended state to the retracted state.

10. A method of operating an exit device, the exit device including a locking mechanism including a latch bolt operable between an extended state and a retracted state, a motor having a motor shaft, a control module operable to control the motor, the control module having a sensing system and a microcontroller, and a link coupling the motor shaft to the latch bolt and movable between locked and unlocked positions, movement of the link between the locked and unlocked positions causing movement of the latch bolt between the extended state and the retracted state, the method comprising:

generating a signal indicative of the position of the link;

operating the motor for moving the link in a first direction toward the unlocked position;

thereafter recording a hard stop value of the signal indicative of a hard stop position of the link;

thereafter determining a soft stop value, the soft stop value being indicative of a soft stop position of the link.

11. The method of claim 10, wherein the sensing system includes a magnet mounted to the link and a Hall effect sensor connected to the microcontroller, and wherein generating the signal includes the Hall effect sensor generating the signal related to the distance between the magnet and the Hall effect sensor.

12. The method of claim 10, wherein determining the soft stop value includes subtracting a first value from the hard stop value.

13. The method of claim 10, wherein operating the motor for moving the link in the first direction includes moving the link at a first speed until the link reaches the hard stop position causing the link to move in a second direction opposite the first direction, the method further comprising subsequent to the link moving in the second direction, operating the motor for moving the link in the first direction at an approach speed until the link reaches the hard stop position, the first speed being greater than the approach speed, wherein recording the hard stop value of the signal is performed subsequent to operating the motor to move the link to the hard stop position at the approach speed.

14. The method of claim 13, wherein determining the soft stop value includes operating the motor for moving the link in the second direction a first distance subsequent to recording the hard stop value, and thereafter recording the soft stop value of the signal.

15. The method of claim 10, wherein operating the motor for moving the link in the first direction includes moving the link at a first speed until the link reaches the hard stop position causing the link to move in a second direction opposite the first direction, the method further comprising, subsequent to recording the hard stop value, operating the motor for moving the link in the first direction at an approach speed until a value of the signal is substantially equal to the hard stop value minus a delta value, the approach speed being lower than the first speed.

16. A method of operating an exit device, the exit device including a locking mechanism for locking and unlocking a door, the locking mechanism having a link movable between locked and unlocked positions, and a motor operably connected to the link, the method comprising:

operating the motor to move the link in a first direction toward the unlocked position; and thereafter operating the motor to stop the link at a soft stop position, wherein the soft stop position is between the locked position of the link and a hard stop position of the link, the hard stop position defining a position where the link is restricted from moving in the first direction, wherein the exit device further comprises a pushbar coupled to the link and movable between an outer state and an inner state such that manual operation of the pushbar to its inner state causes no movement of the link but operating the motor to move the link in the first direction causes the pushbar to move to its inner state.

17. The method of claim 16, the method further comprising generating a signal indicative of the position of the link, wherein operating the motor to move the link in the first direction includes operating the motor until the value of the signal is substantially equal to a previously determined soft stop value indicative of the soft stop position.

18. The method of claim 16, wherein operating the motor to move the link includes applying a first power to the motor, and wherein operating the motor to stop the link includes applying a second power to the motor, the first power being greater than the second power.

19. A method of operating an exit device, the exit device including a locking mechanism including a latch bolt operable between an extended state and a retracted state, a motor having a motor shaft, a control module operable to control the motor, the control module having a sensing system and a microcontroller, and a link coupling the motor shaft to the locking mechanism, the method comprising:

generating a signal indicative of the position of the link;

operating the motor for moving the link in a first direction;

thereafter recording a hard stop value of the signal indicative of a hard stop position of the link;

thereafter determining a soft stop value, the soft stop value being indicative of a soft stop position of the link, wherein operating the motor for moving the link in the first direction includes moving the link at a first speed until the link reaches the hard stop position causing the link to move in a second direction opposite the first direction, the method further comprising subsequent to the link moving in the second direction, operating the motor for moving the link in the first direction at an approach speed until the link reaches the hard stop position, the first speed being greater than the approach speed, wherein recording the hard stop value of the signal is performed subsequent to operating the motor to move the link to the hard stop position at the approach speed.

20. The method of claim 19, wherein determining the soft stop value includes, operating the motor for moving the link in the second direction a first distance subsequent to recording the hard stop value, and thereafter recording the soft stop value of the signal.

21. A method of operating an exit device, the exit device including a locking mechanism including a latch bolt operable between an extended state and a retracted state, a motor having a motor shaft, a control module operable to control the motor, the control module having a sensing system and a microcontroller, and a link coupling the motor shaft to the locking mechanism, the method comprising:

generating a signal indicative of the position of the link;

operating the motor for moving the link in a first direction;

thereafter recording a hard stop value of the signal indicative of a hard stop position of the link;

thereafter determining a soft stop value, the soft stop value being indicative of a soft stop position of the link, wherein operating the motor for moving the link in the first direction includes moving the link at a first speed until the link reaches the hard stop position causing the link to move in a second direction opposite the first direction, the method further comprising, subsequent to recording the hard stop value, operating the motor for moving the link in the first direction at an approach speed until a value of the signal is substantially equal to the hard stop value minus a delta value, the approach speed being lower than the first speed.

22. A method of operating an exit device, the exit device including a locking mechanism for locking and unlocking a door, the locking mechanism having a link movable between locked and unlocked positions, and a motor operably connected to the link, the method comprising:

operating the motor to move the link in a first direction toward the unlocked position; and thereafter operating the motor to stop the link at a soft stop position, wherein the soft stop position is between the locked position of the link and a hard stop position of the link, the hard stop position defining a position where the link is restricted from moving in the first direction, wherein operating the motor to move the link includes applying a first power to the motor, and wherein operating the motor to stop the link includes applying a second power to the motor, the first power being greater than the second power.

* * * * *